United States Patent [19]

Hoffman

[11] Patent Number: 4,568,120

[45] Date of Patent: Feb. 4, 1986

[54] HOOK-ON TYPE BABY SEAT

[75] Inventor: Ronald R. Hoffman, Morgantown, Pa.

[73] Assignee: Graco Metal Products Inc., Elverson, Pa.

[21] Appl. No.: 623,689

[22] Filed: Jun. 22, 1984

[51] Int. Cl.[4] ..... A47B 39/00

[52] U.S. Cl. ..... 297/174; 297/134

[58] Field of Search ..... 297/174, 134; 182/53, 182/55, 59, 60, 61

[56] References Cited

U.S. PATENT DOCUMENTS

| | | | |
|---|---|---|---|
| 367,259 | 7/1887 | Witek | 182/61 |
| 1,326,415 | 12/1919 | Negus et al. | 297/174 X |
| 1,798,022 | 3/1931 | Lentz | 182/60 |
| 2,324,570 | 7/1943 | Figgins | 297/352 |
| 3,133,760 | 5/1964 | Robinson | 297/174 |
| 4,312,535 | 1/1982 | Smith | 297/174 |
| 4,506,928 | 3/1985 | Marion | 297/174 |

FOREIGN PATENT DOCUMENTS 281700 7/1952 Switzerland .

*Primary Examiner*—William E. Lyddane
*Assistant Examiner*—Laurie K. Cranmer
*Attorney, Agent, or Firm*—Seidel, Gonda, Goldhammer & Abbott

[57] ABSTRACT

The baby seat has a forwardly projecting anchor member which is adapted to overlie a table or the like and a pair of gripping members below said anchor member for gripping a bottom surface of a table or the like. A latch extends between the grip members and the back of the baby seat for latching the grip members in position.

12 Claims, 6 Drawing Figures

FIG. 1
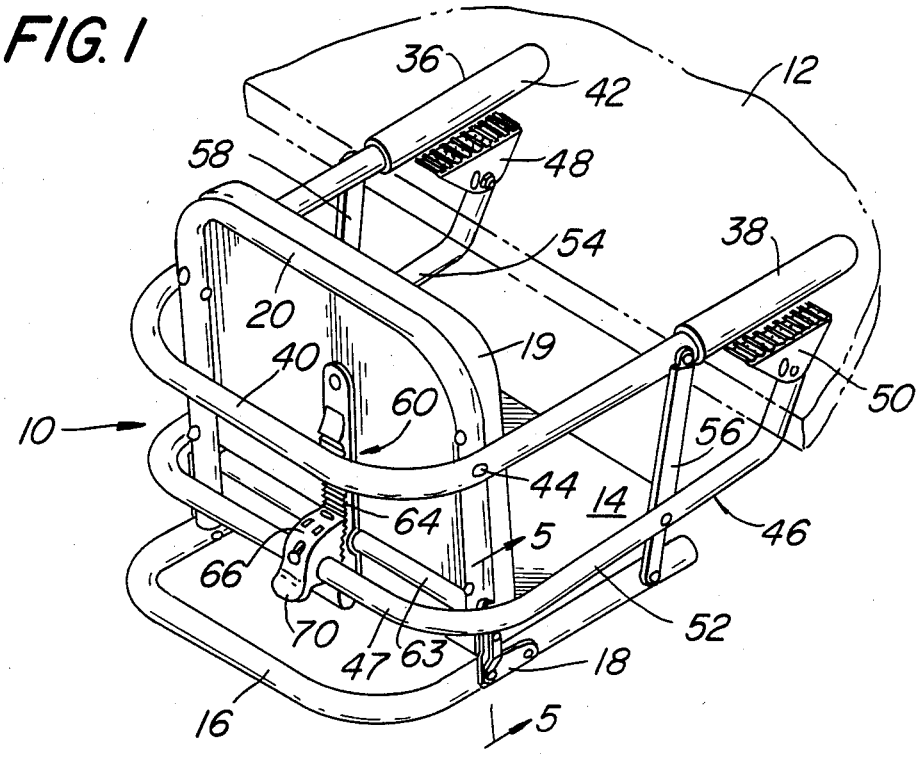
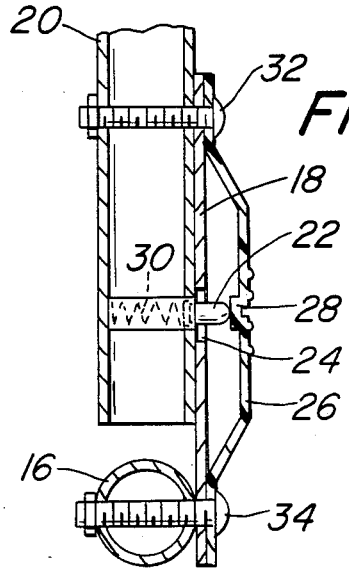
FIG. 5
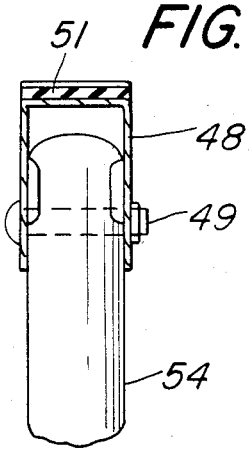
FIG. 6

HOOK-ON TYPE BABY SEAT

BACKGROUND

Hook-on type baby seats are presently known and have several deficiencies. The baby seats are not securely fastened to the table whereby they are readily separable from the table by pulling in a horizontal direction. Further, the seat tilts according to the thickness of the table.

The presennt invention is designed to overcome the above deficiencies.

SUMMARY OF THE INVENTION

The present invention is directed to a hook-on type baby seat which includes a seat portion and a back portion coupled to a forwardly projecting anchor member. The anchor member is adapted to overlie a table or the like. The baby seat includes a grip means having a pair of free ends below the anchor member for gripping a bottom surface of the table or the like. The free ends of said grip means are supported for movement toward and away from the elevation of the anchor member. A latch means extends between the grip means and the back portion of the baby seat for latching the free ends of said grip means in one of a plurality of positions.

Various objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a baby seat in accordance with the present invention attached to a table top.

FIG. 5 is a sectional view taken along the 5—5 in FIG. 1 but on an enlarged scale.

FIG. 6 is a sectional view taken along the line 6—6 in FIG. 2 but on an enlarged scale.

DETAILED DESCRIPTION

Figure 2:
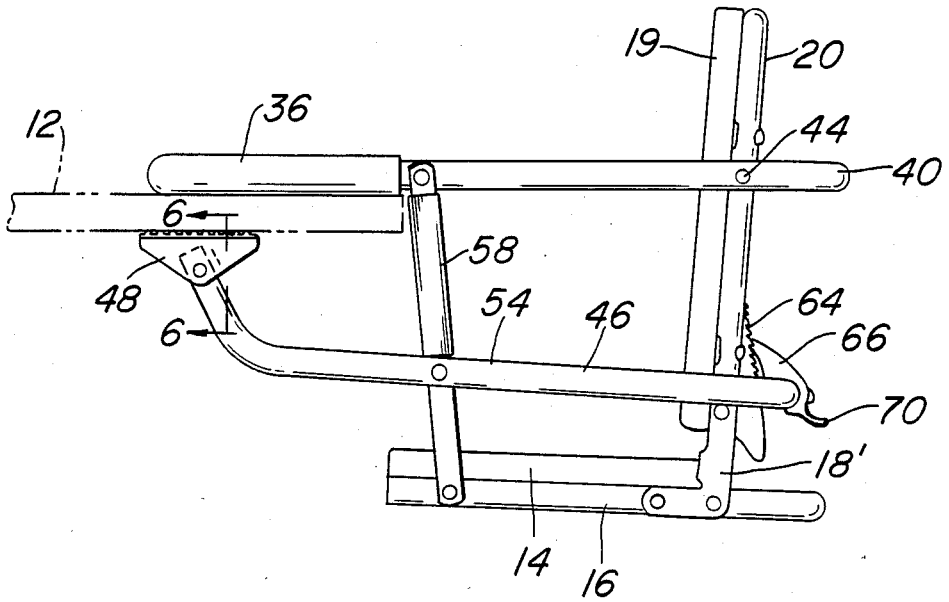
FIG. 2 is a side elevation view of the structure shown in FIG. 1 as seen from the left in FIG. 1.
Figure 3:
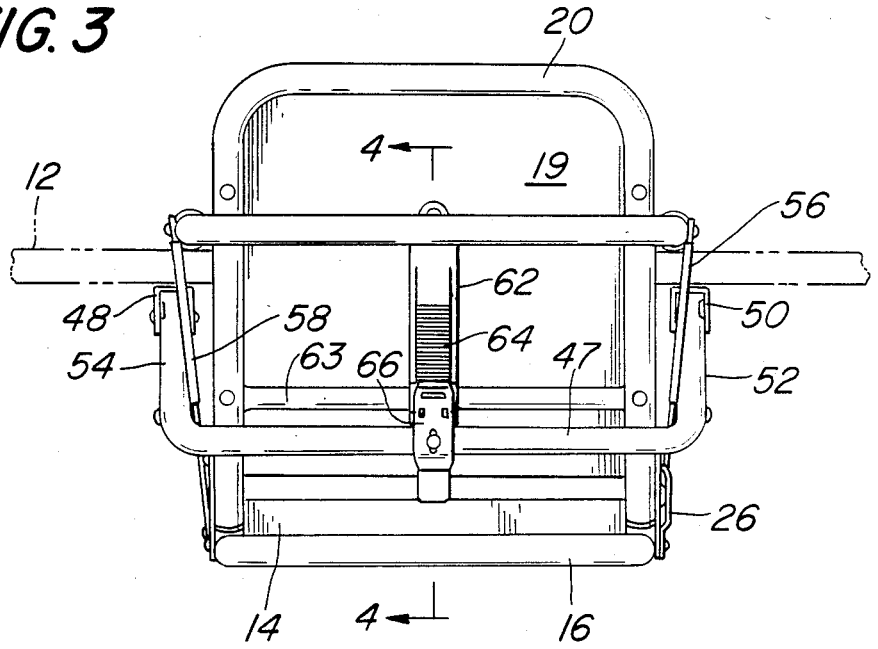
FIG. 3 is a rear elevation view of the baby seat shown in FIGS. 1 and 2.

Referring to the drawings in detail, wherein like numerals indicate like elements, there is shown in FIG. 1 a baby seat in accordance with the present invention designated generally as 10. The baby seat is illustrated as being attached to a table top 12 which may be a kitchen table, picnic table, shelf, etc.

The baby seat 10 includes a seat portion 14 attached to a U-shaped frame 16. A back portion is attached to a U-shaped frame 20. The frames 16 and 20 are preferably non-corrosive hollow metal tubes which have been chrome plated or otherwise protected. Each leg of the frame 16 is connected to an adjacent leg of the frame 20 by a bracket 18 or a bracket 18'.

As shown more clearly in FIGS. 1, 2 and 5, each of the brackets 18, 18' is L-shaped. The generally horizontal leg of bracket 18 is secured by fasteners to a leg of the frame 16. The vertical leg of the bracket has a hole 24 so that a pin 22 on a leg of the frame 20 may extend therethrough. See FIG. 5. A plastic button release 26 has a projection 28 in contact with the pin 22. When the button release 26 is pushed inwardly, spring 30 associated with pin 22 is compressed and pin 22 is moved completely to the left of hole 24 whereby the back portion 19 may collapse with respect to the seat portion 14. A fastener 34 secures one end of the button release 26 and a portion of the bracket 18 to the seat frame 16. A fastener 32 secures the other end of button release 26 and a portion of the bracket 18 to the frame 20. When the back portion 19 is collapsed with respect to the seat portion 14, the fasteners 32 act as pivot pins. There is no release button 26 associated with bracket 18'.

The baby seat 10 includes a pair of anchor members 36 and 38 which overlie the table top 12. Anchor members 36 and 38 constitute the free end portions of a U-shaped frame 40. The portion of the anchor members which are adapted to contact a table top are preferably provided with a sleeve 42 therearound to prevent marring of the tabletop. The sleeves 42 are preferably made from a polymeric plastic material. Each leg of the frame 40 is secured to a juxtaposed leg of the frame 20 by a pin 44.

Below the elevation of the anchor member 36 there is provided a grip member 48. Below the anchor member 38 there is provided a grip member 50. Each of the grip members 48 and 50 is generally U-shaped in section as shown in FIG. 6 and has a plastic gripping pad 51 with transverse corrugations on its upper surface.

Grip member 48 is pivotably connected to leg 54 of a U-shaped frame 46. Grip member 50 is similarly pivotably connected to leg 52 of said frame 46 whose bight is designated 47. The frame 46 supporting the grip members 48 and 50 is below the elevation of the U-shaped frame 40 and above the elevation of the U-shaped frame 16. Each grip member is pivotably connected to its associated leg by a pivot pin 49. See FIG. 6.

A link 56 has its upper end pivotably connected to one leg of the frame 40 and its lower end pivotably connected to one leg of the frame 16. Intermediate its ends, link 56 is pivotably connected to leg 52 of the frame 46. A similar link is provided on the opposite side of the baby seat 10 and designated 58. See FIG. 2. Link 58 is pivoted to frames 16, 46 and 40 in the same manner as described above with respect to link 56.

A latch means designated 60 is provided and extends between the back portion 19 and the bight 47 on the frame 46. The latch means includes a rack 62 having a notch on its rear surface which receives the ridge 63. Ridge 63 is fastened to the rear surface of the back portion 19 whereby the rack 62 cannot move vertically. Rack 62 has 24 teeth on an arcuate portion thereof. The teeth are designated 64. The teeth 64 extend through an arcuate length of the rack 62 corresponding to an angle of 25° with the apex of thhe angle being at the radius of curvature approximately 8.4 inches from the teeth 64.

Figure 4:
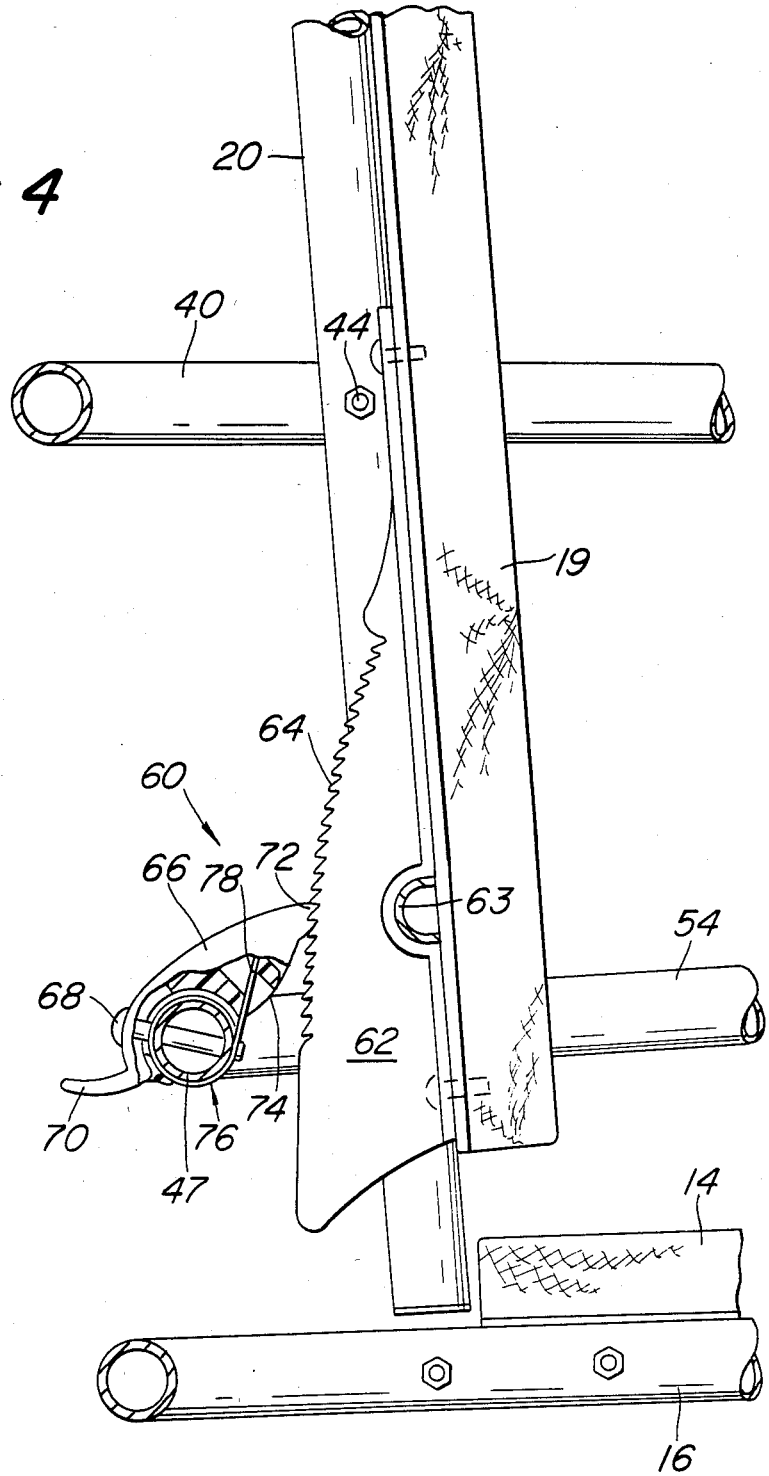
FIG. 4 is an enlarged detail view of the latch means as seen along the line 4—4 in FIG. 3.

A pawl 66 is attached to the bight 47 on the frame 46 by fastener 68. The pawl 66 has a handle 70 to facilitate manipulation of the teeth 72 thereon with respect to the teeth 64. It will be noted that pawl 66 preferably has a pair of teeth 72. The pawl 62 does not interfere with folding or collapsing of the baby seat 10. Pawl 66 has an arcuate belly portion 74 to prevent the pawl from catching in the teeth 64 during folding of the back portion relative to the seat portion. The pawl 66 is biased to the position shown in FIG. 4 by the spring 76. Spring 76 has a portion surrounding the bight 47 on frame 46 and a portion 78 which extends into the pawl 66.

The baby seat 10 is attached to the table 12 as follows. Pressure is applied to handle 70 to overcome the bias of spring 76 and disengage teeth 72 from teeth 64. The bight 47 is then pivoted upwardly to thereby provide a sufficient gap between the anchor members 36, 38 and the grip members 48, 50. The baby seat is then moved horizontally until the anchor members 36 and 38 overlie the table top 12. And thereafter, the handle 70 may be released to cause the teeth 72 to mesh with the teeth 64. Thereafter, pressure is applied on the bight 47 to pivot it downwardly whereby the grip members 48 and 50 move upwardly toward their associated anchor member and contact a bottom surface of the table. And thereafter, a slight pressure is applied to the bight 47 to move the teeth 72 downwardly to the next teeth 64 therebelow. The baby seat 10 is now latched to the tabletop 12 with sufficient gripping force that the table top 12 may be pulled merely by pulling on the baby seat 10. The back portion 19 and the seat portion 14 always remain in the same desired angular relationship regardless of the thickness of the table top 12 since said portions are retained in an operative position by pin 22 which extend through hole 24 in bracket 18.

In order to release the baby seat 10, it is only necessary to repeat the above steps in the reverse order. Since a plastic sleeve or a plastic pad are the only portions that engaged the table top 12, the table top 12 will not be marred by contact with a portion of the baby seat 10.

The present invention may be embodied in other specific forms without departing from the spirit or essential attributes thereof and, accordingly, reference should be made to the appended claims, rather than to the foregoing specification, as indicating the scope of the invention.

I claim:

1. A hook-on type baby seat comprising a seat portion and a back portion coupled to a forwardly projecting anchor member which is adapted to overlie a table top or the like and a grip means having a pair of free ends below the elevation of said anchor member for gripping a bottom surface of the table or the like, means movably coupling said grip means to said anchor member and said seat portion, said free ends of said grip means being supported for movement toward and away from the elevation of said anchor member, and latch means extending between said grip means and the back portion for latching the free ends of said grip means in one of a plurality of positions.

2. A baby seat in accordance with claim 1 wherein said latch means includes a rack having a set of teeth along an arcuate portion of the rack, said rack being attached to said back portion, a pawl attached to said grip means for movement with said grip means, said pawl having teeth adapted to mesh with the teeth on said rack.

3. A baby seat in accordance with claim 2 wherein said pawl is spring biased into a position wherein said teeth on the pawl engage teeth on the rack.

4. A baby seat in accordance with claim 1 wherein said grip means includes a U-shaped frame having a grip member on each of its free ends, the bight of said last mentioned frame being adjacent a rear surface of said back portion, one element of said latch means being on said rear surface of said back portion and the cooperating element of the latch means being on said bight.

5. A baby seat in accordance with claim 1 wherein said grip means includes a pair of grip members each pivotably secured to their support and having a resilient pad attached to their uppermost surface which is adapted to contact a bottom surface of a table or the like.

6. A hook-on type baby seat comprising a seat portion and a back portion coupled together for movement between an operative and inoperative position, a first U-shaped frame coupled to said back portion and terminating in a pair of free end portions adapted to overlie a table top or the like, a second U-shaped frame below the elevation of said first mentioned frame, said second frame terminating at its free end portions in a grip member, each grip member being below and generally aligned with one of the anchor members thereabove, means movably coupling said second mentioned frame to said first mentioned frame and seat portion, a latch means extending between said back portion and the bight of said second mentioned frame for latching the grip members in one of a plurality of positions.

7. A baby seat in accordance with claim 6 wherein said latch means includes a rack having a set of teeth along an arcuate portion of the rack, said rack being attached to said back portion, a pawl on said second frame and having teeth adapted to mesh with the teeth on said rack.

8. A baby seat in accordance with claim 7 wherein said pawl is spring biased into a position wherein said teeth on the pawl engage teeth on the rack.

9. A baby seat in accordance with claim 6 wherein said grip members are each pivotably secured to said second frame and have a resilient pad attached to their uppermost surface which is adapted to contact a bottom surface of a table or the like.

10. A baby seat in accordance with claim 6 including a U-shaped frame on said back portion pivoted to a U-shaped frame on said seat portion.

11. A baby seat in accordance with claim 7 wherein each leg of said first frame is pivoted to said back portion, a plastic sleeve telescoped over the free end portion of said first frame.

12. A baby seat in accordance with claim 6 including a button release for releasing a pin holding said seat and back portions in their operative position.

* * * * *